US009127425B2

(12) United States Patent
Outcalt et al.

(10) Patent No.: US 9,127,425 B2
(45) Date of Patent: Sep. 8, 2015

(54) GRANULAR SPREADER ASSEMBLY

(71) Applicant: Meyer Products, LLC, Cleveland, OH (US)

(72) Inventors: Andrew Outcalt, Avon Lake, OH (US); Martin Warchola, Medina, OH (US)

(73) Assignee: Meyer Products, LLC, Cleveland, OH (US)

( * ) Notice: Subject to any disclaimer, the term of this patent is extended or adjusted under 35 U.S.C. 154(b) by 177 days.

(21) Appl. No.: 13/826,861

(22) Filed: Mar. 14, 2013

(65) Prior Publication Data

US 2014/0263764 A1 Sep. 18, 2014

(51) Int. Cl.
*E01H 10/00* (2006.01)
*A01C 7/20* (2006.01)
*E01C 19/20* (2006.01)

(52) U.S. Cl.
CPC ..... *E01H 10/007* (2013.01); *E01C 19/203* (2013.01)

(58) Field of Classification Search
CPC ..... E01H 10/007
USPC ..... 239/650–689; 198/676–677, 657, 198/659–660, 662–664; 366/150.1, 156.1, 366/157.3, 157.4; 222/352, 412–413, 222/240–241
See application file for complete search history.

(56) References Cited

U.S. PATENT DOCUMENTS

| | | | | |
|---|---|---|---|---|
| 3,684,082 | A | 8/1972 | Wardell | |
| 4,157,150 | A | 6/1979 | Hetrick | |
| 4,166,581 | A | 9/1979 | Hetrick | |
| 4,192,418 | A | 3/1980 | Montgomery | |
| 4,621,968 | A * | 11/1986 | Hutchison | 414/311 |
| 5,085,313 | A * | 2/1992 | Naumec et al. | 198/659 |
| 5,407,123 | A | 4/1995 | Rode | |
| 5,802,994 | A | 9/1998 | Kinkead | |
| 6,089,478 | A * | 7/2000 | Truan et al. | 239/675 |
| 6,446,879 | B1 | 9/2002 | Kime | |
| 6,702,208 | B1 | 3/2004 | Hadler et al. | |
| 6,715,703 | B2 | 4/2004 | Kost | |
| 6,722,590 | B2 | 4/2004 | Kost | |
| 6,978,952 | B2 | 12/2005 | Kost | |
| 7,540,436 | B2 | 6/2009 | Truan et al. | |
| 8,215,477 | B2 * | 7/2012 | Basaglia et al. | 198/666 |
| 8,262,004 | B2 | 9/2012 | Gamble et al. | |
| 2007/0034721 | A1 | 2/2007 | Owenby | |
| 2010/0200680 | A1 * | 8/2010 | Hobbs et al. | 239/687 |
| 2011/0259979 | A1 | 10/2011 | Kost et al. | |

OTHER PUBLICATIONS

International Search Report, Korean Intellectual Property Office, for International Application No. PCT/US2013/055112, Dec. 4, 2013.

* cited by examiner

*Primary Examiner* — Len Tran
*Assistant Examiner* — Toungminh Pham
(74) *Attorney, Agent, or Firm* — Roger D. Emerson; Timothy D. Bennett; Emerson Thomson Bennett

(57) ABSTRACT

An auger may have a spiral blade that extends radially outwardly from a shaft and that has resiliently-deformable material at the radial outer edge that physically contacts the inner surface of the tube in which the auger is positioned. When the auger is not rotated, the physical contact of the resiliently-deformable material on the inner surface of the tube may prevent granular material from flowing through the opening in the tube.

20 Claims, 12 Drawing Sheets

FIG. I

GRANULAR SPREADER ASSEMBLY

I. BACKGROUND OF THE INVENTION

A. Field of Invention

This invention pertains to the art of methods and devices used to spread granular material on ground surfaces, and more specifically to a granular spreader assembly using an auger that prevents granular material flow when the auger is not rotating.

B. Description of the Related Art

Granular spreader assemblies that spread granular material on ground surfaces are well known. One example is provided in U.S. Pat. No. 6,715,703 titled Spreader ("the '703 patent") which is incorporated herein by reference. The '703 patent discloses a granular spreader assembly that has a storage container (hopper) that holds granular material, such as salt. The storage container is supported to a vehicle. A portion of FIG. 7 from the '703 patent is shown in FIG. 12 which shows the storage container 1 having an opening 2 through which the granular material flows when exiting the storage container 1. A tube 3 has an inner surface defining an opening 4 that communicates with the opening 2 in the storage container 1. An auger 5 is positioned within the tube 3 and has a spiral blade 6. Motor 7 is used to rotate the auger 5 and a spreader plate 8. When rotated, the auger 5 moves or flows the granular material from the storage container 1, along the spiral blade 6, through the opening 4 in the tube 3, and onto the spreader plate 8. If the spreader plate 8 is rotated, the granular material contacts the spreader plate 8 and is then spread onto the ground surface.

The granular spreader assembly shown in FIG. 12, and others like it, generally work well for their intended purposes. They have a problem, however, that commonly occurs when the vehicle transporting the granular spreader assembly comes to a stop, such as at a stop sign or traffic light. When the vehicle stops, the continued spreading of the granular material at that location must also stop or that location will be over covered with granular material. Such over covering is a waste of granular material and may be detrimental to the ground surface at that location.

To address this problem it is known to stop the rotation of the auger and the spreader plate when the vehicle comes to a stop. While this action stops the wide disbursement of the granular material, it does not stop the flow of the granular material onto the ground surface. With reference again to FIG. 12, the granular material continues to flow because there is a gap between the radial outer edge of the spiral blade 6 and the tube surface defining the tube opening 4 that permits the granular material to flow therethrough. This gap is visible in FIG. 12. The granular material also continues to flow because the surface of the spiral blade 6 is smooth (typically made of a smooth metal) permitting the granular material to flow on the smooth surface of the spiral blade 6 through the opening 4 in the tube 3.

One potential solution is to reduce the gap (or clearance) between the radial outer edge of the spiral blade and the tube surface defining the tube opening. While this "solution" may have merit in a workshop setting where working conditions are ideal (a warm environment, clean working conditions, etc.) it has little or no merit in actual use where the working conditions are not ideal (very cold in winter, dirty, etc.). In actual "real world" use such a small clearance could not be maintained and soon the spiral blade would contact the tube which would wear if not damage the auger and/or the tube. Such contact would also require additional power to rotate the auger against the resultant excessive friction.

What is needed, then, is a granular spreader assembly that stops the flow of granular material when the rotation of the auger is stopped and that is useful in "real world" working conditions.

II. SUMMARY

According to one embodiment of this invention, a granular spreader assembly may comprise: a storage container, a tube and an auger. The storage container may: (1) be supportable to an associated vehicle positioned on an associated ground surface; (2) be suitable to contain associated granular material; and, (3) comprise an opening through which the associated granular material flows when exiting the storage container. The tube may have an inner surface defining an opening that communicates with the opening in the storage container. The auger may: (1) comprise a shaft having an axial centerline; (2) comprise a spiral blade that: (a) extends radially outwardly from the shaft; (b) has a first section and a second section that is non-continuous with the first section; wherein the first section wraps around the shaft at least 360 degrees in a spiral manner; and, the second section wraps around the shaft at least 360 degrees in a spiral manner; and, (c) comprise resiliently-deformable material at the radial outer edge. The auger may: (3) be positioned within the opening in the tube such that the resiliently-deformable material physically contacts the inner surface of the tube defining the opening in the tube; and, (4) be positioned with the axial centerline at an angle that is one of: (a) perpendicular with respect to the associated ground surface; and, (b) an acute angle of at least 45 degrees with respect to the associated ground surface. The auger may be adjusted between: (1) a first condition where the shaft is rotated about its axial centerline to flow the associated granular material from the storage container, along the spiral blade, through the opening in the tube, and onto the associated ground surface; and, (2) a second condition where the shaft is not rotated about its axial centerline and the spiral blade prevents the associated granular material from flowing through the opening in the tube.

According to another embodiment of this invention, a granular spreader assembly may comprise: a storage container, a tube and an auger. The storage container may: (1) be supportable to an associated vehicle positioned on an associated ground surface; (2) be suitable to contain associated granular material; and, (3) comprise an opening through which the associated granular material flows when exiting the storage container. The tube may have an inner surface defining an opening that communicates with the opening in the storage container. The auger may: (1) comprise a shaft having an axial centerline; (2) comprise a spiral blade that: (a) extends radially outwardly from the shaft; (b) wraps around the shaft at least 360 degrees in a spiral manner; and, (c) comprises resiliently-deformable material at the radial outer edge; (3) be positioned within the opening in the tube such that the resiliently-deformable material physically contacts the inner surface of the tube defining the opening in the tube; and, (4) be positioned with the axial centerline at an angle that is one of: (a) perpendicular with respect to the associated ground surface; and, (b) an acute angle of at least 30 degrees with respect to the associated ground surface. The auger may be adjusted between: (1) a first condition where the shaft is rotated about its axial centerline to flow the associated granular material from the storage container, along the spiral blade, through the opening in the tube, and onto the associated ground surface; and, (2) a second condition where the shaft is not rotated about its axial centerline and the spiral blade prevents the associated granular material from flowing through the opening in the tube.

According to yet another embodiment of this invention, an auger kit may be used with a granular spreader assembly comprising: a storage container that: (1) is supportable to an associated vehicle positioned on an associated ground surface; (2) is suitable to contain associated granular material; and, (3) comprises an opening through which the associated granular material flows when exiting the storage container; a tube having an inner surface defining an opening that communicates with the opening in the storage container; and, a first auger that: (1) comprises a shaft having an axial centerline; (2) comprises a spiral blade that: (a) extends radially outwardly from the shaft; and, (b) wraps around the shaft in a spiral manner; (3) is positioned within the opening in the tube; (4) is positioned with the axial centerline at an angle that is one of: (a) perpendicular with respect to the associated ground surface; and, (b) an acute angle of at least 30 degrees with respect to the associated ground surface; and, (5) is operable by rotating the shaft about its axial centerline to flow the associated granular material from the storage container, along the spiral blade, through the opening in the tube, and onto the associated ground surface. The auger kit may comprise: a second auger that: (1) comprises a shaft having an axial centerline; (2) comprises a spiral blade that: (a) extends radially outwardly from the shaft; (b) wraps around the shaft at least 360 degrees in a spiral manner; and, (c) comprises resiliently-deformable material at the radial outer edge; (3) replaces the first auger; (4) is positioned within the opening in the tube such that the resiliently-deformable material physically contacts the inner surface of the tube defining the opening in the tube; (5) is positioned with the axial centerline at an angle that is one of: (a) perpendicular with respect to the associated ground surface; and, (b) an acute angle of at least 30 degrees with respect to the associated ground surface; and, can be adjusted between: (1) a first condition where the shaft is rotated about its axial centerline to flow the associated granular material from the storage container, along the spiral blade, through the opening in the tube, and onto the associated ground surface; and, (2) a second condition where the shaft is not rotated about its axial centerline and the spiral blade prevents the associated granular material from flowing through the opening in the tube.

Numerous benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

VI. DETAILED DESCRIPTION OF THE INVENTION

Figure 1:
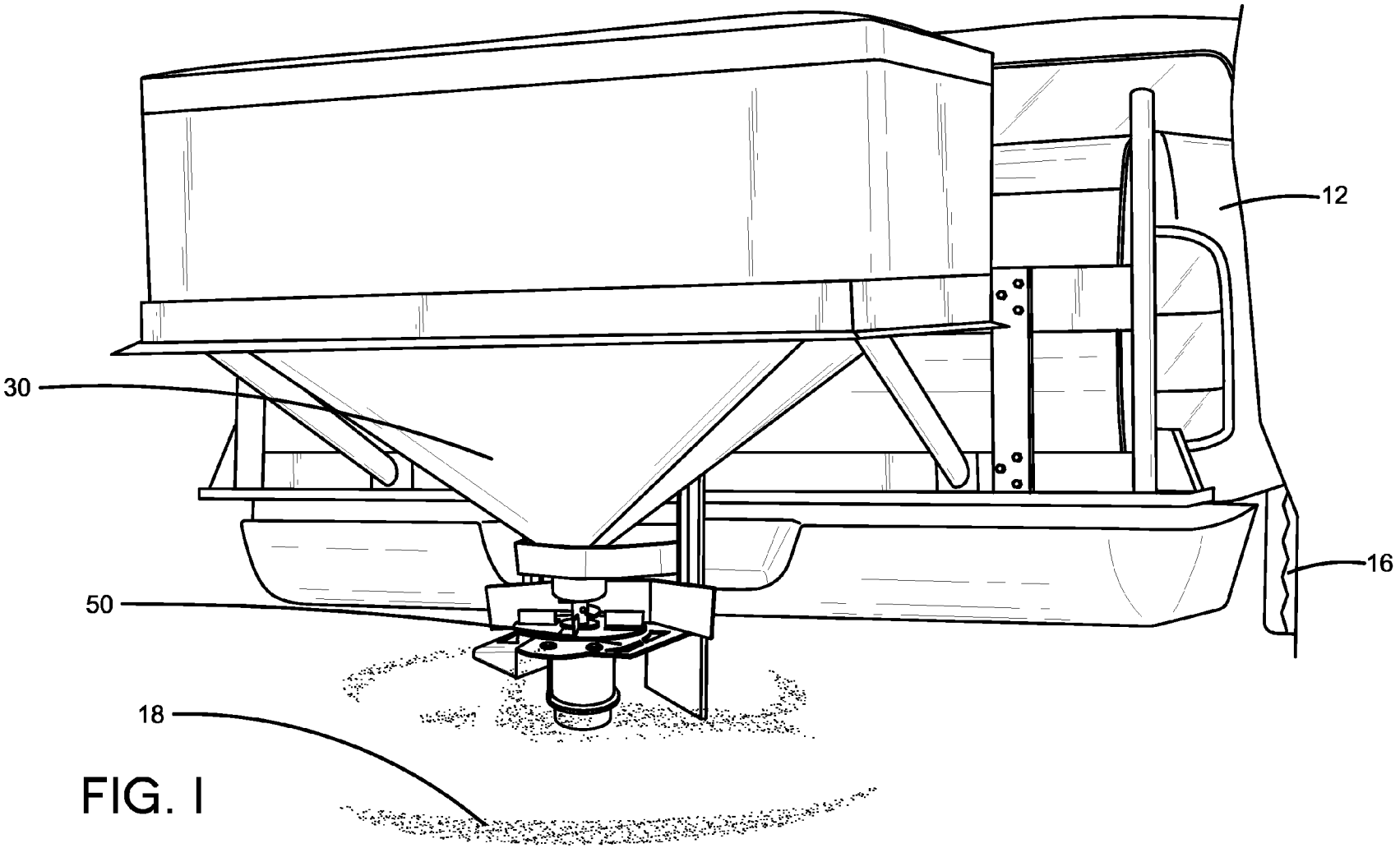
FIG. 1 is a back perspective view of a pickup truck which uses an auger according to embodiments of this invention.
Figure 2:
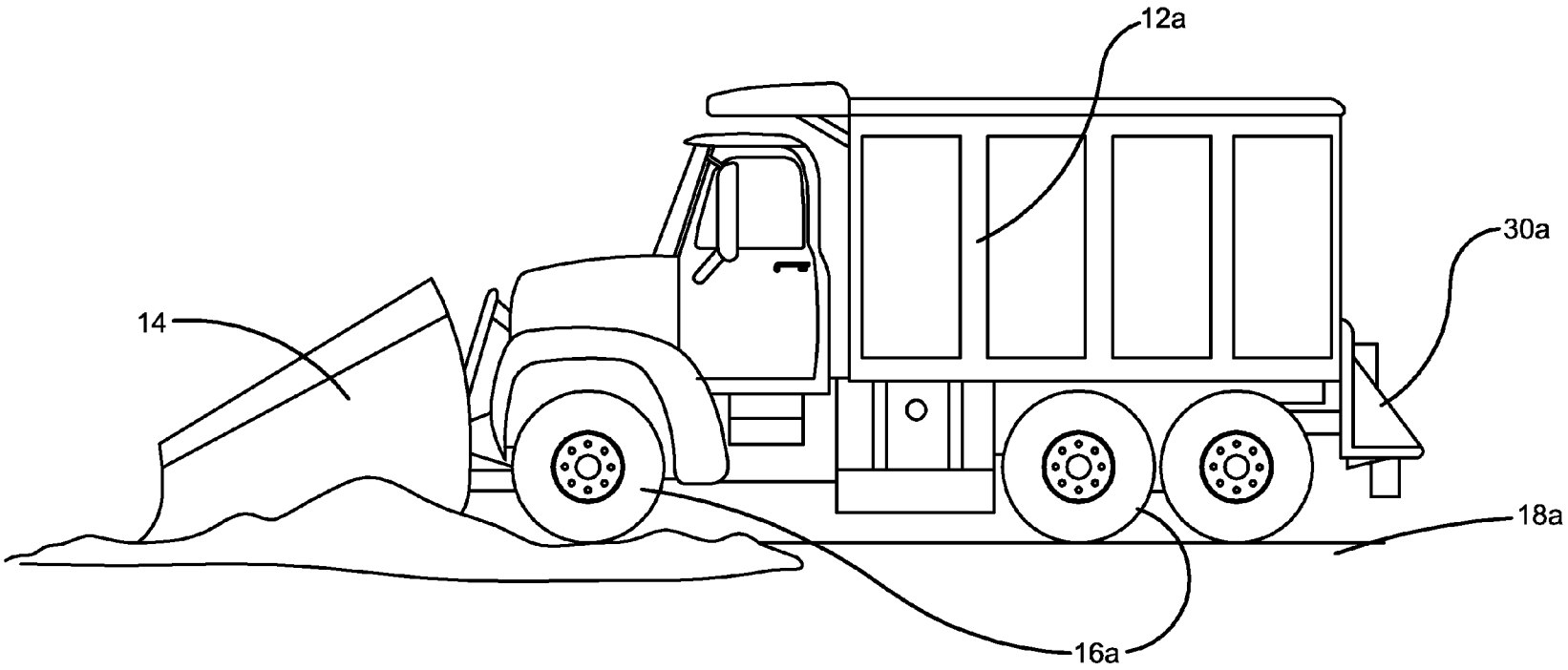
FIG. 2 is a side view of a dump truck which uses an auger according to embodiments of this invention.
Figure 3:
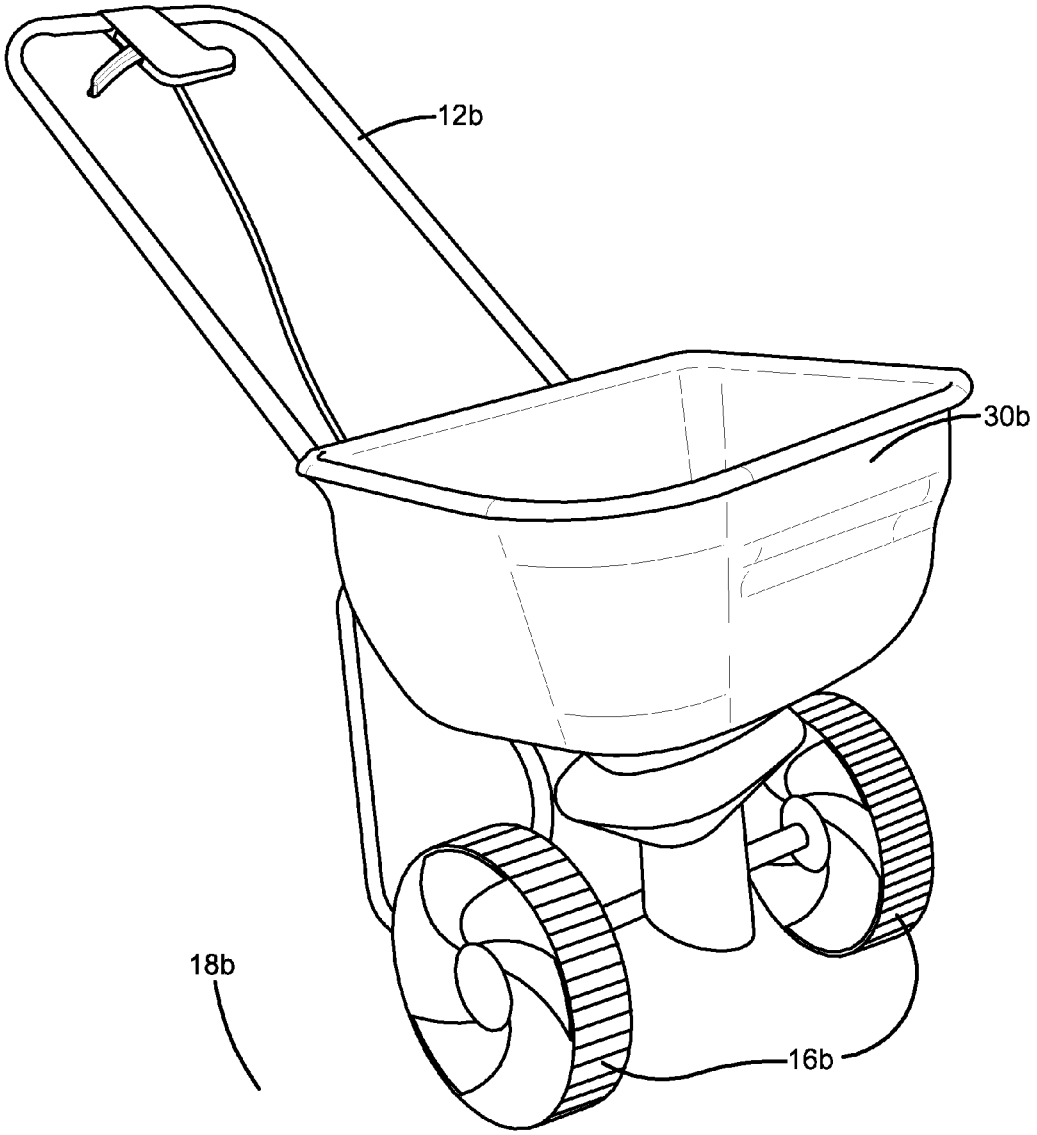
FIG. 3 is a front perspective view of a manually movable walk behind unit which uses an auger according to embodiments of this invention.

Referring now to the drawings wherein the showings are for purposes of illustrating embodiments of the invention only and not for purposes of limiting the same, and wherein like reference numerals are understood to refer to like components, FIG. 1 shows a vehicle 12 having wheels 16 positioned on ground surface 18. Attached to the vehicle 12 is a granular spreader assembly 30 using an auger 50 according to some embodiments of this invention. The granular spreader assembly 30 spreads or applies granular material, such as salt or sand, onto the ground surface 18 in a known manner. While the vehicle shown is a pick-up truck it should be understood that the granular spreader assembly 30 and/or auger 50 of this invention can be used with any type of vehicle chosen with the sound judgment of a person of skill in the art. FIG. 2, for example, shows a granular spreader assembly 30*a* using an auger according to this invention supported to a dump truck 12*a* having wheels 16*a* positioned on ground surface 18*a*. The granular spreader assembly 30*a* spreads or applies granular material, such as salt or sand, onto the ground surface 18*a* in a known manner and also has a snow plow system 14 used to plow snow on the ground surface 18*a*. FIG. 3 shows another application where a granular spreader assembly 30*b* using an auger according to this invention is supported to a manually movable "walk behind" unit 12*b* having wheels 16*b* positioned on ground surface 18*b*. The granular spreader assembly 30*b* spreads or applies granular material onto the ground surface 18*b* in a known manner. It should be noted that the granular material being spread with the granular spreader assembly and/or auger can be any chosen with the sound judgment of a person of skill in the art. Non-limiting examples include salt, sand, seeds, fertilizer, pesticide, herbicide, fungicide, nuts, coal, rice, and beans. The granular spreader assembly and/or auger of this invention may have non-vehicle applications as well.

Figure 4:
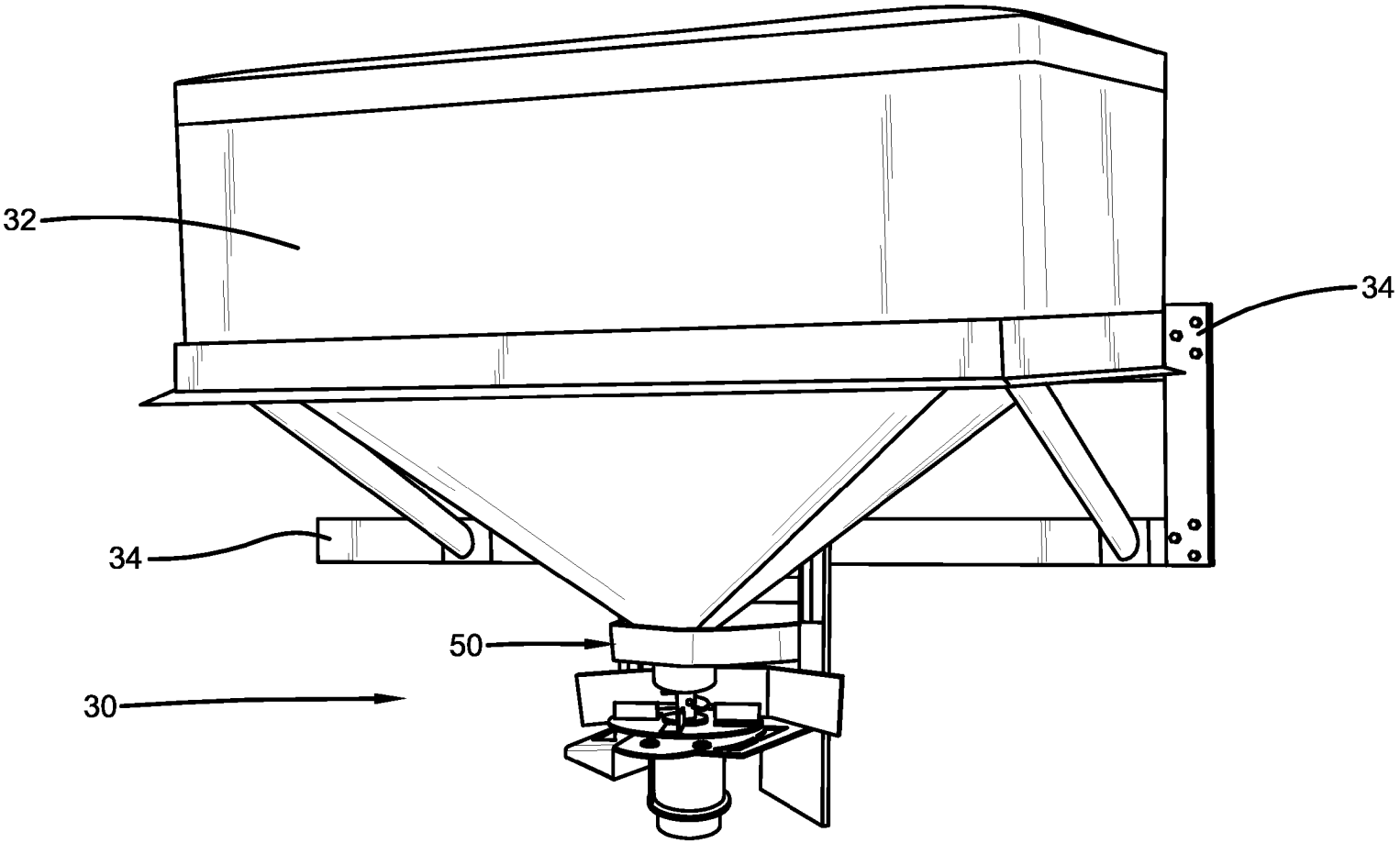
FIG. 4 is a back perspective view of the granular spreader assembly of FIG. 1.

FIG. 4 shows the granular spreader assembly 30 of FIG. 1 detached from any vehicle. The granular spreader assembly 30 may include a storage container 32, sometimes referred to as a hopper, which holds the granular material that is to be spread or dispersed onto a ground surface. The granular spreader assembly 30 may also include support structure 34 that supports or attaches the storage container 32 to a vehicle. The particular support structure used can be any chosen with the sound judgment of a person of skill in the art that is appropriate for the particular vehicle to which the granular spreader assembly 30 will be supported.

Figure 5:
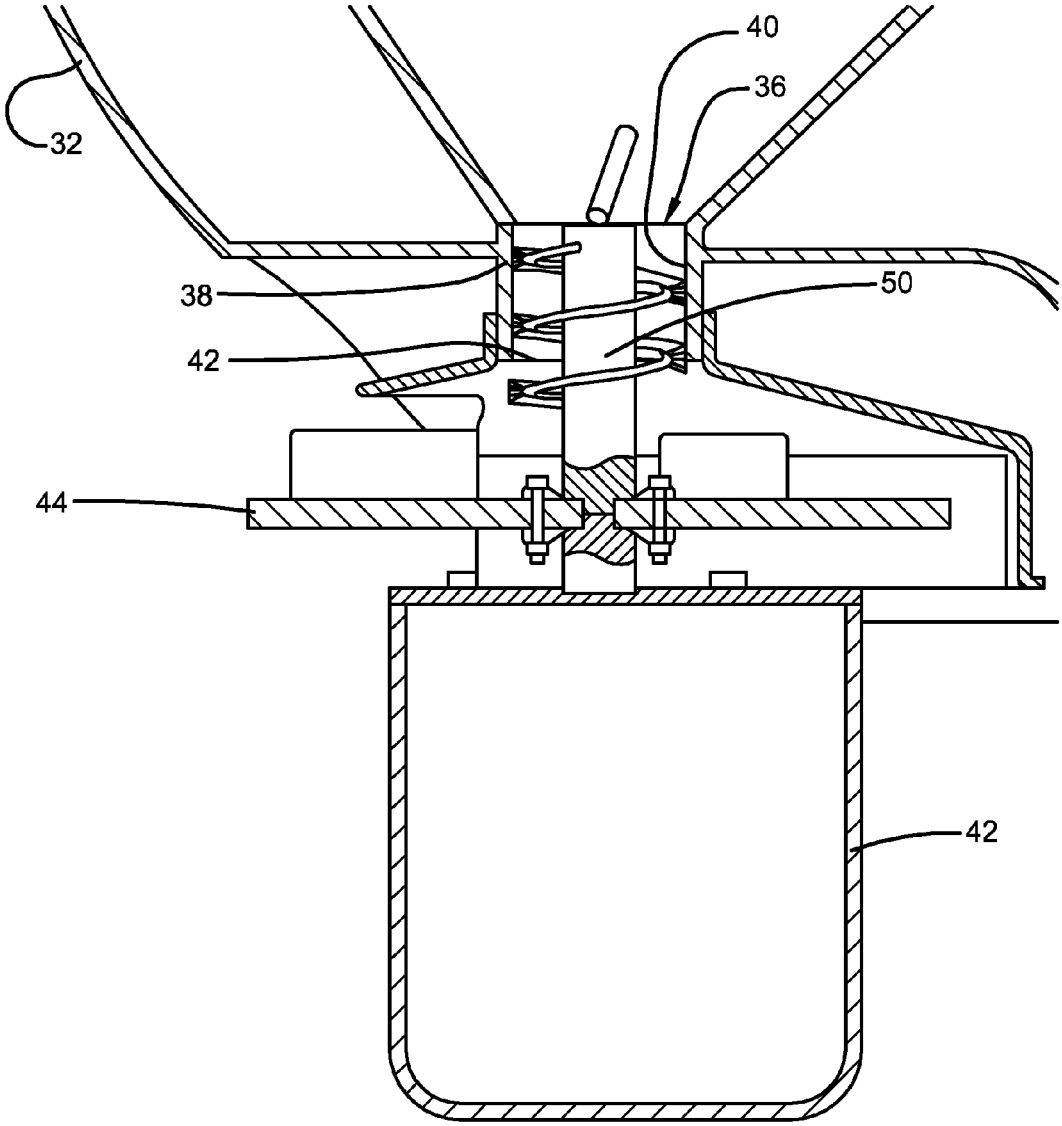
FIG. 5 is a partial sectional view of a portion of a granular spreader assembly showing an auger within a tube according to some embodiments of this invention.

With reference now to FIGS. 4 and 5, the storage container 32 may have an opening 36 through which the granular material flows when exiting the storage container 32. A tube 38 having an inner surface 40 defines an opening 42 that communicates with the opening 36 in the storage container 32. The tube 38 may be positioned just below the storage container 32, as shown. Below the tube 38, a spreader plate 44 that may be rotated by motor 46 may be positioned and used, as is well known by those of skill in the art, to spread or disperse the granular material as it exits the opening 36 of the tube 38 onto the ground surface. In one embodiment, the motor 46 also rotates the auger 50. In another embodiment, a different power source, such as a different motor, is used to rotate the auger 50.

Figure 6:
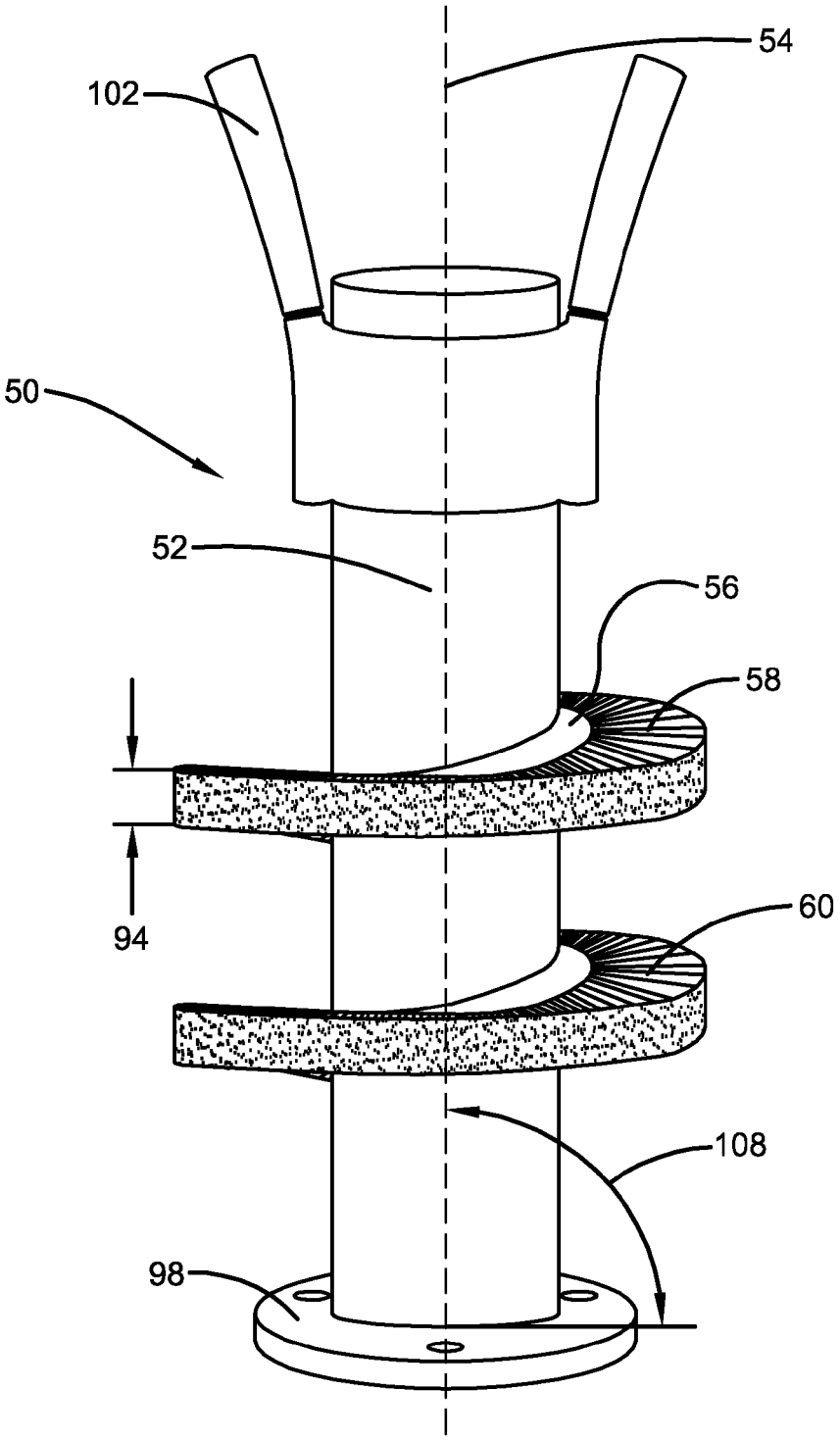
FIG. 6 is a side view of an auger according to some embodiments of this invention.
Figure 7:
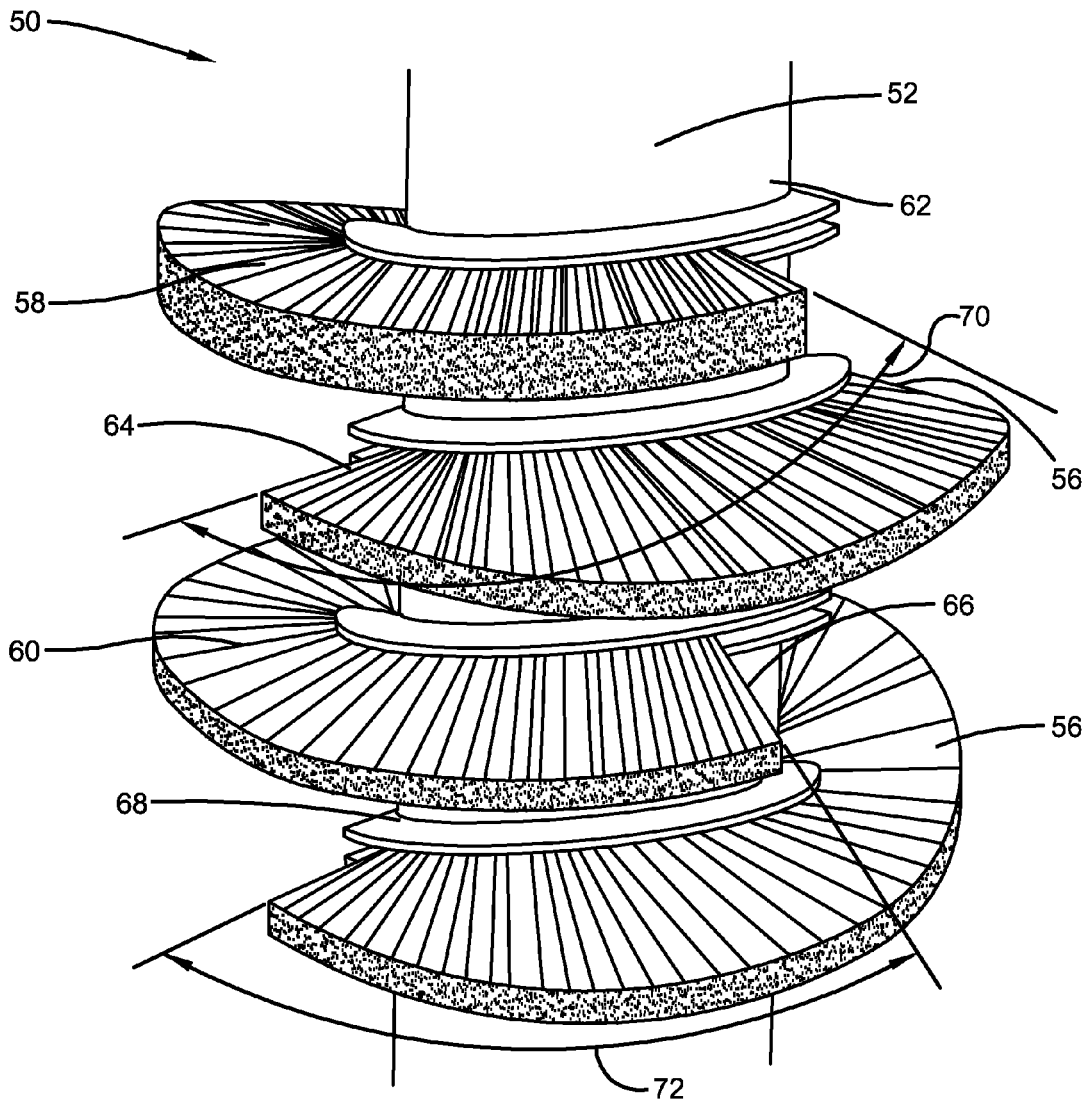
FIG. 7 is a close-up view of an auger according to some embodiments of this invention showing the overlap portions of spiral blade sections.

With reference now to FIGS. 5-7, the auger 50 may include a shaft 52, having an axial centerline 54, and a spiral blade 56. By "auger" it is meant any shaft having a blade on its outer surface that conveys (or moves or flows) material in contact with the blade when the shaft is rotated. The shaft 52 can be of any type, shape and material chosen with the sound judgment of a person of skill in the art. The spiral blade 56 may extend radially outwardly from the shaft 52 and may wrap around the shaft 52 at least 360 degrees in a spiral manner. In one embodiment, shown, the spiral blade 56 has first and second sections, 58, 60 that each wrap around the shaft 52 at least 360 degrees in a spiral manner. The first section 58 is positioned axially above the second section 60 in the embodiment shown in FIG. 7. In another embodiment, also shown, the first and second sections, 58, 60 are non-continuous. By "non-continuous" it is meant that there is a break (or space or gap) between the nearest ends of the first and second sections 58, 60 making the spiral wrap that they form incomplete. The first section 58 may have first and second ends 62, 64 and the second section 60 may have first and second ends 66, 68, as shown. The nearest ends of the first and second sections 58, 60 are the second end 64 of the first section 58 and the first end 66 of the second section 60. There is a space between the juxtaposed ends 64, 66 making the first and second sections 58, 60 non-continuous. While the spiral blade 56 shown has two sections 58, 60, in other embodiments the spiral blade 56 may have three, four or more non-continuous sections, as chosen by a person of skill in the art.

With reference now to FIGS. 6-7, in one embodiment, at least one of the first and second sections 58, 60 wrap around the shaft 52 more than 360 degrees. For the embodiment shown, both of the first and second sections 58, 60 wrap around the shaft 52 more than 360 degrees. When the spiral blade 56, or any section 58, 60, wraps around the shaft 52 more than 360 degrees, an axial overlap portion is formed. By an "axial overlap portion" it is meant the portion of the spiral blade 56, or any section 58, 60 thereof, which wraps more 360 degrees around the shaft 52. For the embodiment shown in FIGS. 6-7, the first section 58 has an axial overlap portion 70 and the second portion has an axial overlap portion 72. The amount of overlap, when used, can be any chosen with the sound judgment of a person of skill in the art. In one embodiment, the axial overlap portions 70, 72 have different arc lengths. In another embodiment, shown, the axial overlap portions 70, 72 have substantially the same arc lengths. In one embodiment the axial overlap portions 70, 72 have an arc length of between 1 and 90 degrees (meaning the spiral blade or blade section wraps around the shaft between 366 and 450 degrees). In a more specific embodiment, the axial overlap portions 70, 72 have an arc length of between 5 and 85 degrees (meaning the spiral blade or blade section wraps around the shaft between 370 and 445 degrees). In a yet more specific embodiment, the axial overlap portions 70, 72 have an arc length of between 10 and 80 degrees (meaning the spiral blade or blade section wraps around the shaft between 370 and 440 degrees). In a more specific embodiment, the axial overlap portions 70, 72 have an arc length of between 20 and 70 degrees (meaning the spiral blade or blade section wraps around the shaft between 380 and 430 degrees). In a yet more specific embodiment, the axial overlap portions 70, 72 have an arc length of between 30 and 60 degrees (meaning the spiral blade or blade section wraps around the shaft between 390 and 420 degrees). In a more specific embodiment, shown, the axial overlap portions 70, 72 have an arc length of between 40 and 50 degrees (meaning the spiral blade or blade section wraps around the shaft between 400 and 410 degrees). In one embodiment, the axial overlap portions 70, 72 are not axially aligned. In another embodiment, shown, the axial overlap portions 70, 72, are substantially axially aligned. The size and alignment of the axial overlap portions 70, 72 may be determined by the designer to meet the specific application based on factors such as the type of granular material to be spread, the material that the spiral blade 56 is made of, and the spiral angle 96 (seen best in FIG. 10). If the axial overlap portions 70, 72 have arc lengths that are more than necessary, the excess spiral blade is a waste of material.

Figure 8:
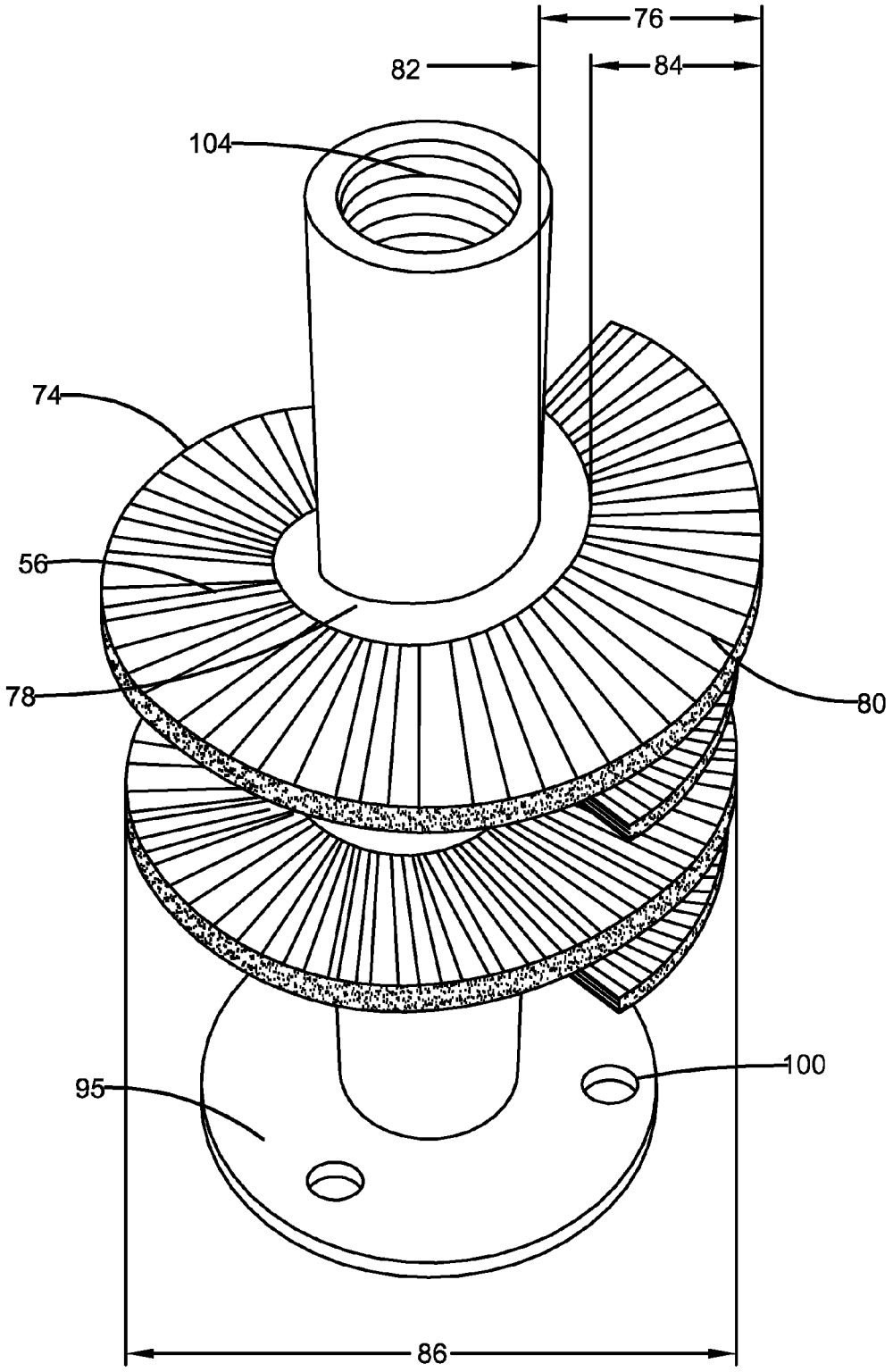
FIG. 8 is a top perspective view of an auger according to some embodiments of this invention.

With reference now to FIGS. 6-8, the spiral blade 56 of the auger 50 may comprise a resiliently-deformable material at the radial outer edge 74, as shown. By "resiliently-deformable" it is meant that the material is easily deformed (only a relatively small force is required to deform it) but that when the force is removed, it substantially returns to its original shape. The spiral blade 56 may have a radial width 76, as shown. In one embodiment, the entire radial width 76 is formed of resiliently-deformable material. In another embodiment, shown, the spiral blade 56 comprises a radially inward portion 78, which may be formed of any material chosen with the sound judgment of a person of skill in the art, and a radially outward portion 80 formed of the resiliently-deformable material. The radially inward portion 78 may have a radial width 82 and the radially outward portion 80 may have a radial width 80. The particular dimensions of the radial widths 82, 84 may be determined by the designer to meet the specific application based on factors such as the type of granular material to be spread, the materials of which the radially inward and outward portions 78, 80, are formed, and the spiral angle 96 (labeled in FIG. 10). In one embodiment, the radial widths 82, 84 are substantially the same (thus each is about 50% of the radial width 76). In another embodiment, the radial width 82 is about 90% of radial width 76 and the radial width 84 is about 10% of radial width 76. In another embodiment, the radial width 82 is about 80% of radial width 76 and the radial width 84 is about 20% of radial width 76. In another embodiment, the radial width 82 is about 70% of radial width 76 and the radial width 84 is about 30% of radial width 76. In another embodiment, the radial width 82 is about 60% of radial width 76 and the radial width 84 is about 40% of radial width 76. In another embodiment, the radial width 82 is about 40% of radial width 76 and the radial width 84 is about 60% of radial width 76. In another embodiment, the radial width 82 is about 60% of radial width 76 and the radial width 84 is about 40% of radial width 76. In another embodiment, the radial width 82 is about 30% of radial width 76 and the radial width 84 is about 70% of radial width 76. In another embodiment, shown, the radial width 82 is about 20% of radial width 76 and the radial width 84 is about 80% of radial width 76. In another embodiment, the radial width 82 is about 10% of radial width 76 and the radial width 84 is about 90% of radial width 76.

With continuing reference to FIGS. 6-8, the specific resiliently-deformable material used with the auger 50 can be any chosen with the sound judgment of a person of skill in the art. In one embodiment, the resiliently-deformable material is rubber. In another embodiment, the resiliently-deformable material is a polymer. In yet another embodiment, shown, the resiliently-deformable material is a collection of bristles, similar to that used in a brush. In one specific embodiment, shown, the radially inward portion 78 is formed of a metal having its radially inward edge welded to the outer surface of the shaft 52 and its radially outward edge defines a pair of arms between which the bristles are inserted. The arms can then be compressed toward each other to secure the bristles to the shaft 52. When the resiliently-deformable material is a collection of bristles, the bristles can be arranged in any manner chosen with the sound judgment of a person of skill in the art.

Figure 10:
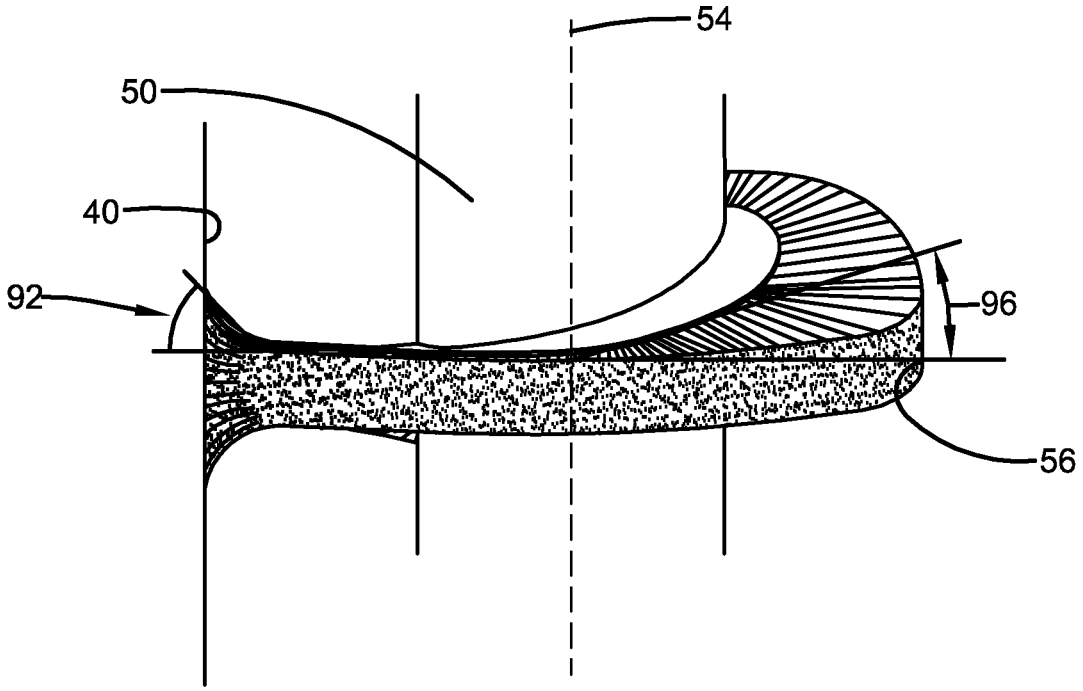
FIG. 10 is a side close-up view showing the deformation of the resiliently-deformable material at the radial outer edge of the auger blade against the inner surface of the tube.
Figure 12:
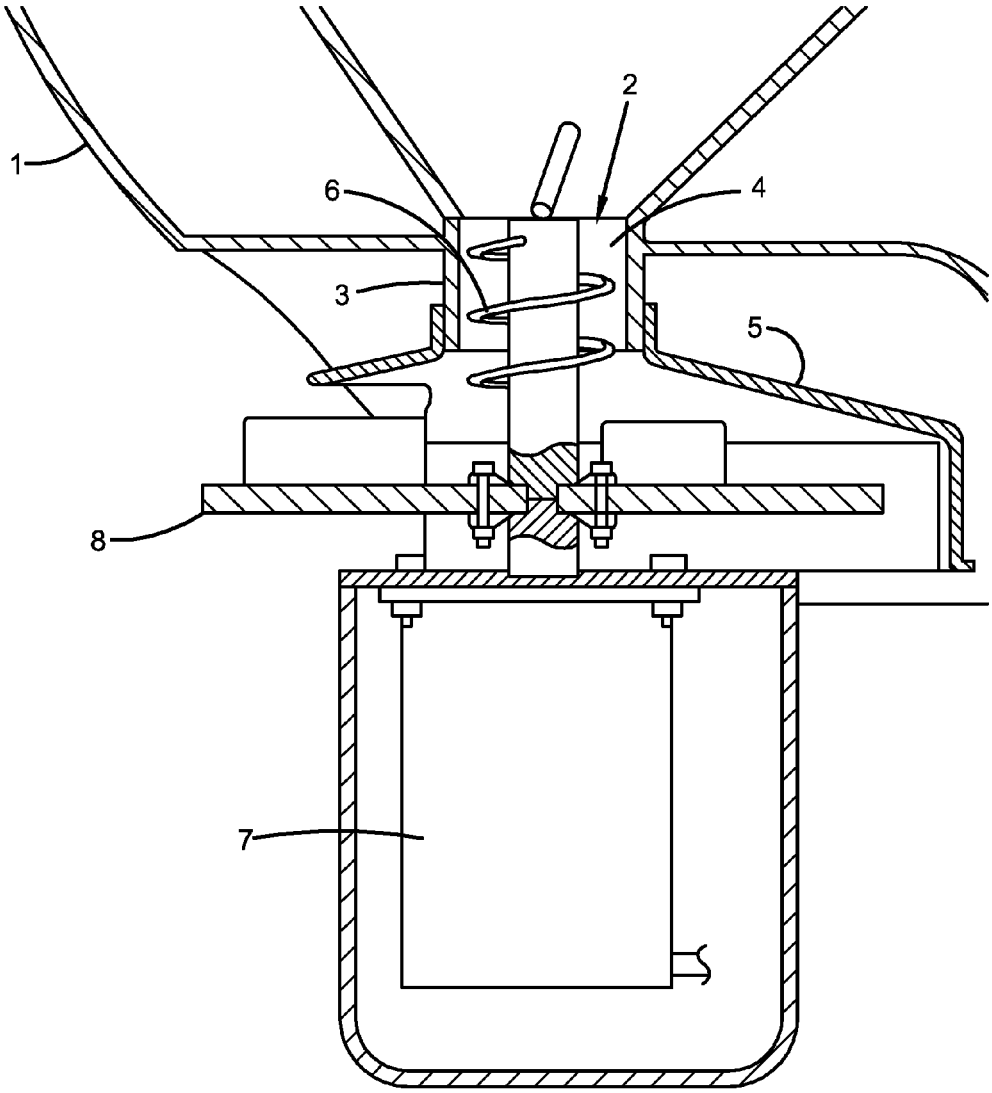
FIG. 12 PRIOR ART
FIG. 12 is a partial sectional view of a portion of a granular spreader assembly showing an auger within a tube according to the prior art.

With reference now to FIGS. 5 and 10, the auger 50 may be positioned within the opening 42 in the tube 38 similar to the way in which the auger 5 is positioned within the tube 3 shown in FIG. 12, except that with this invention the resiliently-deformable material of the spiral blade 56 physically contacts the inner surface 40 of the tube 38 that defines the opening 42. In other words, the outside diameter 86 of the auger 50 is equal to, or greater than, the inside diameter of the opening 42. In this way the gap or clearance between the radial outer edge of the spiral blade and the tube surface defining the tube opening is removed but without concern for damage to components. There is no gap or clearance for the granular material to flow through, as is known in the prior art. The resiliently-deformable material that contacts the tube 38 has a long wear life. If necessary, the resiliently-deformable material can be replaced. Alternatively, an auger having resiliently-deformable material can be replaced with a newer/unworn auger. The resiliently-deformable material may also form a rough (non-smooth) upper surface for the blade, thus minimizing or eliminating the flow of granular material along the surface of the blade.

Figure 9:
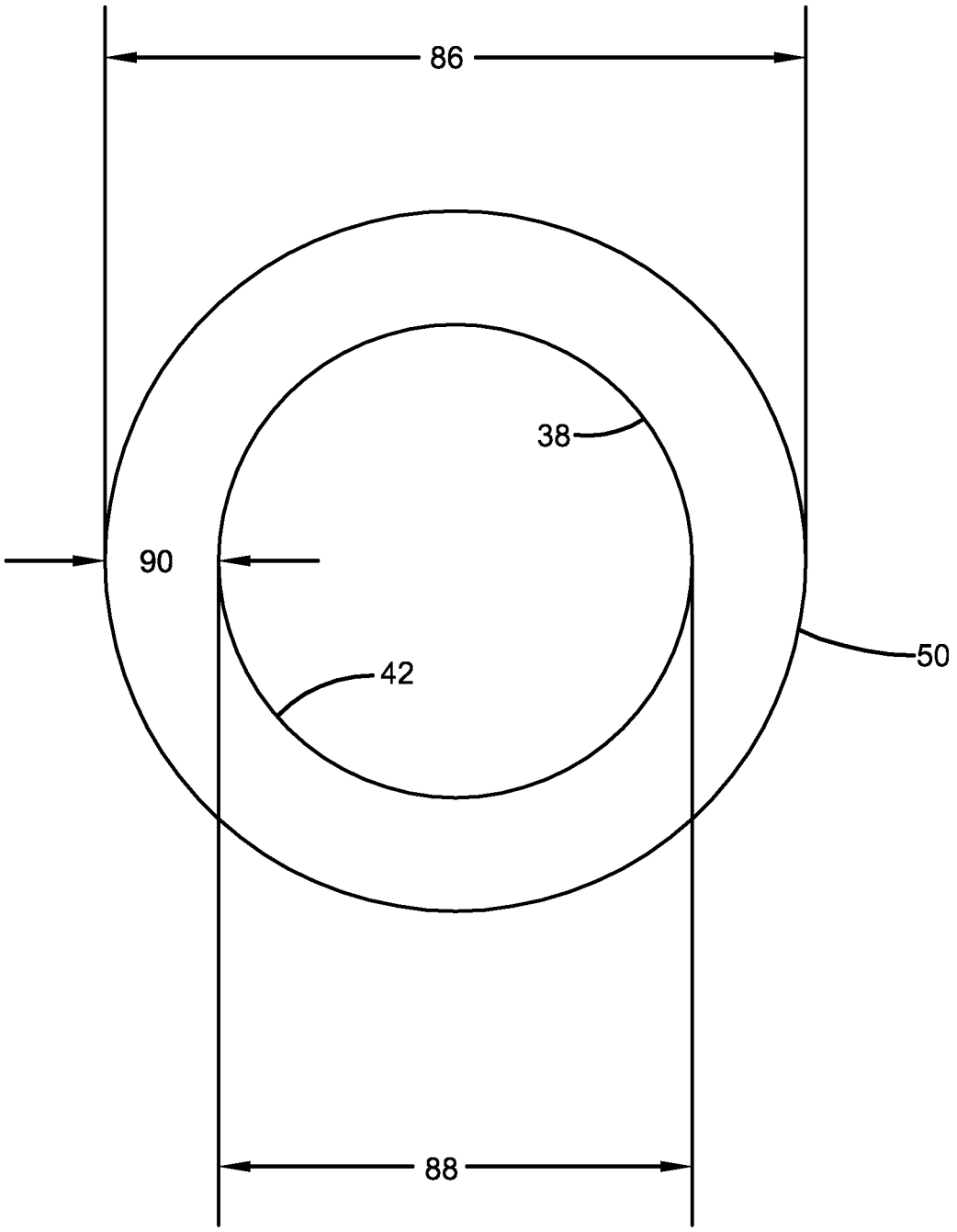
FIG. 9 is a top view illustrating the interference amount when the outside diameter of the auger is greater than the inside diameter of the opening in the tube.

With reference now to FIGS. 8-10, when the outside diameter 86 of the auger 50 is greater than the inside diameter of the opening 42, the amount that is greater defines an interference amount. This is illustrated in FIG. 9 which shows outside diameter 86 of the auger 50, the inside diameter 88 of the opening 42 in the tube 38, and the resultant interference amount 90. In one embodiment, the interference amount 90 is at least 1/16 of an inch. In another embodiment, the interference amount 90 is at least 1/8 of an inch. In yet another embodiment, the interference amount 90 is at least 1/4 of an inch. The interference amount 90 may be made up entirely of the resiliently-deformable material. FIG. 9 shows the auger 50 and the opening 42 as being circles with the resultant interference amount 90 being the same along 360 degrees of the auger/blade. Because the spiral blade 56 and/or its sections 58, 60, may have overlap portions, as discussed above, the wrap around the shaft may be more than 360 degrees and thus the interference amount 90 may occur for more than 360 degrees of the auger/blade. It is also contemplated to form the spiral blade 56 to not have a consistent radial width 76. In this case, the resultant interference amount 90 may occur over less than 360 degrees of the auger/blade. In one specific embodiment, the interference amount 90 is over 180 degrees of the auger/blade. When the spiral blade 56 of the auger 50 has a resiliently-deformable material at the radial outer edge 74, the interference amount 90 is deformed (or bent or crushed) against the inner surface 40 of the tube 38 that defines the opening 42. This deformation 92 is shown in FIG. 10. The type and amount of deformation 92 will depend on the resiliently-deformable material used and on the interference amount 90.

With reference now to FIGS. 6 and 10, the radially outward portion of the blade may have an axial thickness 94 of any amount chosen with the sound judgment of a person of skill in the art. In one embodiment, the axial thickness 94 is at least 1/16 of an inch. In another embodiment, the axial thickness 94 is at least 1/8 of an inch. In yet another embodiment, the axial thickness 94 is at least 1/4 of an inch. The spiral blade 56 may form a spiral angle 96 with respect to the axial centerline 54 of the shaft 52. The spiral angle 96 can be any chosen with the sound judgment of a person of skill in the art. In one embodiment, the spiral angle 96 is consistent over the length of the blade 56. In another embodiment, the spiral angle 96 varies over the length of the blade 56.

Figure 11:
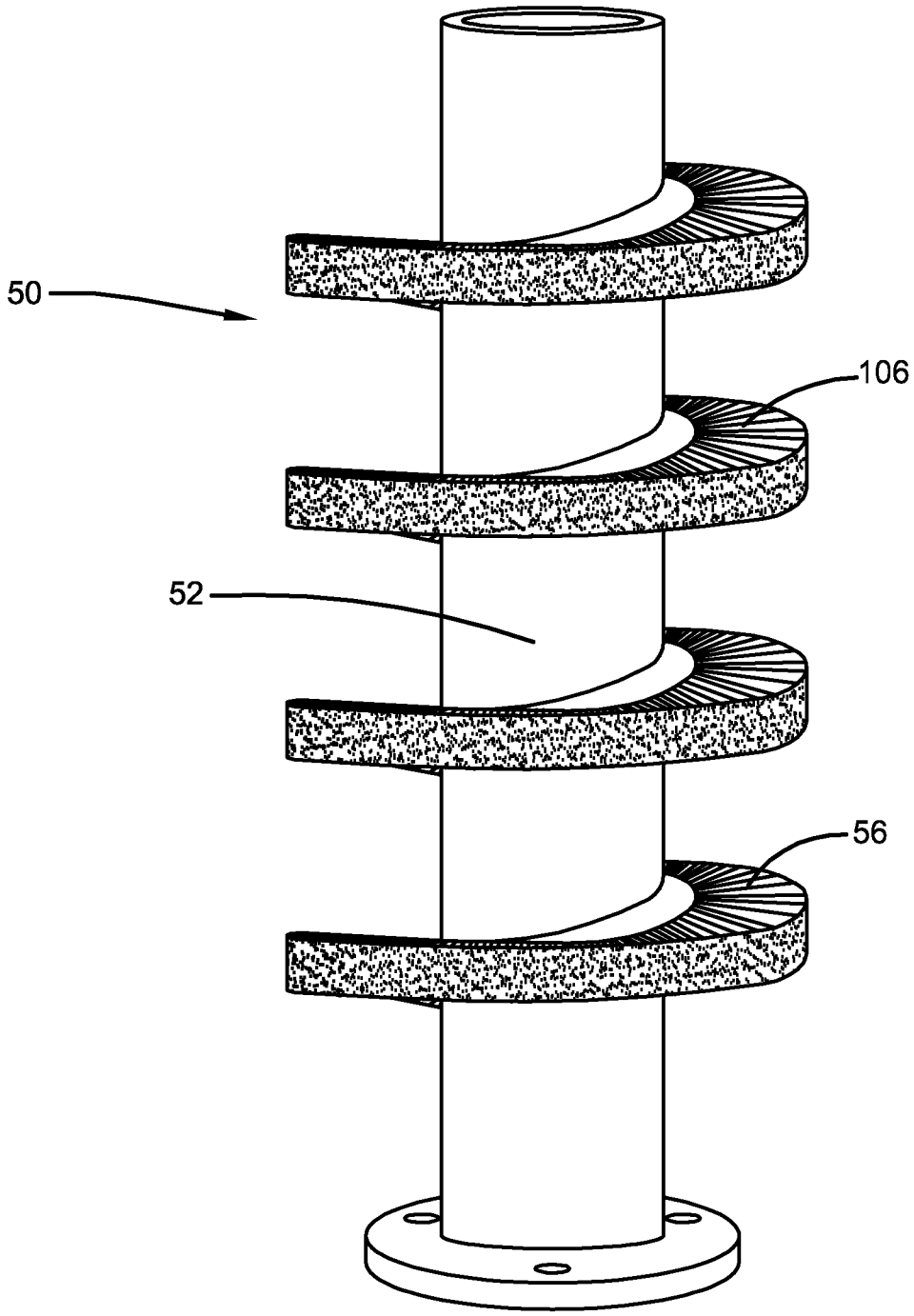
FIG. 11 is a side view of an auger according to some embodiments of this invention.

With reference now to FIGS. 6 and 8, the auger 50 may be attached to the granular spreader 30 in any manner chosen with the sound judgment of a person of skill in the art. In one embodiment, shown, a flange 98 is attached to the shaft 52 and has openings 100 that receive fasteners that fasten the auger 50 to the spreader plate 44. The top of the shaft 52 may have an agitator 102 that extends into the storage container 32 to loosen the granular material so that the granular material flows toward the opening 36. The top of the shaft 52 may have threads 104 to which the agitator 102 is attached. In another embodiment, shown in FIG. 11, the top of the shaft 52 has another blade 106 which may have resiliently-deformable material, as shown, similar to the blade 56. In this way, the blade 106 causes the granular material to flow from within the storage container 32 down to the opening 36.

With reference now to FIGS. 5-6, the auger 50 and the tube 38 may be oriented in any manner chosen with the sound judgment of a person of skill in the art. Typically, augers used in the sand and salt spreading industry, as with the embodiments shown, are oriented or positioned with the axial centerline 54 of the shaft 52 at an angle 108 that is perpendicular, 90 degrees, with respect to the ground surface. The auger 50 of this invention will work well when the angle 108 is 90 degrees. In another embodiment, it will also work well when the angle 108 is an acute angle of at least 30 degrees. In yet another embodiment, the auger 50 of this invention will work well when the angle 108 is an acute angle of at least 45 degrees.

With reference now to all the FIGURES, in operation the auger 50 can be adjusted between: (1) a first condition where the shaft 52 is rotated, for example by motor 42, about its axial centerline 54 to flow the associated granular material from the storage container 32, along the spiral blade 56, through the opening 42 in the tube 38, and onto the ground surface 18; and, (2) a second condition where the shaft 52 is not rotated about its axial centerline 54 and the spiral blade 56 prevents the granular material from flowing through the opening 42 in the tube 38 (primarily because the resiliently-deformable material at the radial outer edge 74 of the spiral blade 56 is positioned within the opening 42 in the tube 38 such that the resiliently-deformable material physically contacts the inner surface 40 of the tube 38).

In another embodiment of this invention, an auger kit comprises an auger like auger 50 described above. The auger kit may be used when it is desired to replace and existing auger. In one embodiment, the existing auger is not made according to the various embodiments of auger 50. It may, for example, be similar to the auger 5 described in the Description of the Related Art above. In another embodiment, the existing auger is made according to any of the various embodiments of auger 50. In any case, to use the auger kit, the existing auger is removed and replaced with an auger 50. The replacement auger 50 can then be used as described above.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A granular spreader assembly comprising:

a storage container that: (1) is supportable to an associated vehicle positioned on an associated ground surface; (2) is suitable to contain associated granular material; and, (3) comprises an opening through which the associated granular material flows when exiting the storage container;

a tube having an inner surface defining an opening that communicates with the opening in the storage container;

an auger that: (1) comprises a shaft having an axial centerline; (2) comprises a spiral blade that: (a) extends radially outwardly from the shaft; (b) has a first section and a second section that is non-continuous with the first section; wherein the first section wraps around the shaft more than 360 degrees in a spiral manner defining an axial overlap portion of between 10 and 80 degrees and, the second section wraps around the shaft more than 360 degrees in a spiral manner defining an axial overlap portion of between 10 and 80 degrees; and, (c) comprises resiliently-deformable material at the radial outer edge; and (3) is positioned within the opening in the tube such that the resiliently-deformable material physically contacts the inner surface of the tube defining the opening in the tube; and, wherein the auger can be adjusted between: (1) a first condition where the shaft is rotated about its axial centerline to flow the associated granular material from the storage container, along the spiral blade, through the opening in the tube, and onto the associated ground surface; and, (2) a second condition where the shaft is not rotated about its axial centerline and the spiral blade prevents the associated granular material from flowing through the opening in the tube.

2. The granular spreader assembly of claim 1 wherein the axial overlap of the first section and the axial overlap of the second section are substantially axially aligned.

3. The granular spreader assembly of claim 1 wherein:

the resiliently-deformable material on the first section of the spiral blade physically contacts the inner surface of the tube defining the opening in the tube with an interference of at least 1/16 of an inch along at least 360 degrees of the first section of the spiral blade wrap; and, the resiliently-deformable material on the second section of the spiral blade physically contacts the inner surface of the tube defining the opening in the tube with an interference of at least 1/16 of an inch along at least 360 degrees of the second section of the spiral blade wrap.

4. The granular spreader assembly of claim 1 wherein the resiliently-deformable material physically contacts the inner surface of the tube defining the opening in the tube with an interference of at least 1/16 of an inch along at least 180 degrees of the spiral blade wrap.

5. The granular spreader assembly of claim 1 wherein the resiliently-deformable material is one of brush bristles, rubber, and polymer.

6. The granular spreader assembly of claim 5 wherein the spiral blade has a radial width and the resiliently-deformable material comprises at least 50% of the radial width.

7. The granular spreader assembly of claim 4 wherein the resiliently-deformable material physically contacts the inner surface of the tube defining the opening in the tube with an interference of at least 1/8 of an inch along at least 180 degrees of the spiral blade wrap.

8. The granular spreader assembly of claim 6 wherein the resiliently-deformable material comprises at least 70% of the radial width.

9. The granular spreader assembly of claim 8 wherein the resiliently-deformable material comprises at least 90% of the radial width.

10. The granular spreader assembly of claim 5 wherein the resiliently-deformable material comprises an axial thickness of at least 1/16 of an inch.

11. The granular spreader assembly of claim 1 wherein the auger is positioned with the axial centerline at an angle that is one of: (a) perpendicular with respect to the associated ground surface; and, (b) an acute angle of at least 45 degrees with respect to the associated ground surface.

12. The granular spreader assembly of claim 11 wherein the auger is positioned with the axial centerline at an angle that is one of: (a) perpendicular with respect to the associated ground surface; and, (b) an acute angle of at least 30 degrees with respect to the associated ground surface.

13. The granular spreader assembly of claim 1 wherein:

the first section wraps around the shaft more than 360 degrees in a spiral manner defining an axial overlap portion of between 20 and 70 degrees; and, the second section wraps around the shaft more than 360 degrees in a spiral manner defining an axial overlap portion of between 20 and 70 degrees.

14. The granular spreader assembly of claim 13 wherein:

the first section wraps around the shaft more than 360 degrees in a spiral manner defining an axial overlap portion of between 30 and 60 degrees; and, the second section wraps around the shaft more than 360 degrees in a spiral manner defining an axial overlap portion of between 30 and 60 degrees.

15. The granular spreader assembly of claim 14 wherein:

the first section wraps around the shaft more than 360 degrees in a spiral manner defining an axial overlap portion of between 40 and 50 degrees; and, the second section wraps around the shaft more than 360 degrees in a spiral manner defining an axial overlap portion of between 40 and 50 degrees.

16. The granular spreader assembly of claim 1 wherein the spiral blade further comprises a third section that is non-continuous with the first and second sections; wherein the third section wraps around the shaft more than 360 degrees in a spiral manner defining an axial overlap portion of between 10 and 80 degrees and, (c) comprises resiliently-deformable material at the radial outer edge.

17. The granular spreader assembly of claim 1 wherein the spiral blade further comprises a fourth section that is non-continuous with the first, second and third sections; wherein the fourth section wraps around the shaft more than 360 degrees in a spiral manner defining an axial overlap portion of between 10 and 80 degrees and, (c) comprises resiliently-deformable material at the radial outer edge.

18. The granular spreader assembly of claim 1 wherein a spreader plate is positioned below the tube and wherein the spreader plate is rotated by a motor to spread and disperse granular material as it exits the opening of the tube onto the ground surface.

19. The granular spreader assembly of claim 11 wherein the motor also rotates the auger.

20. The granular spreader assembly of claim 11 wherein a motor, separate from the motor which rotates the spreader plate, is used to rotate the auger.

* * * * *